United States Patent [19]

Bottarelli et al.

[11] Patent Number: 4,798,045

[45] Date of Patent: Jan. 17, 1989

[54] PROCESS FOR SPLICING FIBERS IN STRIPS, AND A MACHINE FOR FEEDING A TEXTILE MACHINE INCORPORATING SUCH A PROCESS

[76] Inventors: Teresio Bottarelli, 13096 Vigliano Biellese, Regione Barazzetto, 24, Italy; Antonio Nulchis, 13014 Cossato, Viale Paietta, 5b, Italy

[21] Appl. No.: 105,531

[22] Filed: Oct. 7, 1987

[51] Int. Cl.[4] ..... B65H 69/06; D01H 15/00

[52] U.S. Cl. ..... 57/22; 19/161.1; 57/261

[58] Field of Search ..... 57/22, 23, 201, 202, 57/333; 19/150, 161.1

[56] References Cited

U.S. PATENT DOCUMENTS 3,339,362 9/1967 Dodson, Jr. et al. ..... 57/22
3,581,486 6/1971 Dibble ..... 57/22
3,619,868 11/1971 Dibble ..... 57/22 X
3,633,352 1/1972 Marriner ..... 57/22
3,871,164 3/1975 Nunn ..... 57/22

*Primary Examiner*—John Petrakes
*Attorney, Agent, or Firm*—Shlesinger, Arkwright & Garvey

[57] ABSTRACT

A process for splicing textile fiber strips, which process comprises directing compressed air onto the fibers from one side of the overlapped fibers until they become matted, and exhausting the air through a filtering element disposed on the other side of the fibers, and is implemented by a machine includes a channel for passing a supply fiber strip therethrough and having an end portion of a standby strip suspended thereabove, and an air-powered means, for splicing the broken portion of the supply strip to the end portion of the standby strip in the event of a break in the supply strip detected by a sensor.

15 Claims, 2 Drawing Sheets

PROCESS FOR SPLICING FIBERS IN STRIPS, AND A MACHINE FOR FEEDING A TEXTILE MACHINE INCORPORATING SUCH A PROCESS

BACKGROUND OF THE INVENTION

The present invention relates to a process for splicing any type of strip fiber, and to a machine for feeding strip fiber to a textile machine. In particular, the invention is used with pre-spinning and pre-combing machines, as well as with dye plant straightening machines. The machine incorporates the process for ensuring non-stop supply of fiber strip to the textile machine, even in the event of a break in one of the strips supplied to the drawing frame on the textile machine. Pre-spinning and pre-combing machines, as well as straightening machines in dye plants, are known to be fed by special equipment having a number of vessels or spools, upon which the textile fibers to be processed are arranged in strips, and strips which are unwound by feed components on the textile machine and fed to the drawing frame. Whenever the strip runs out and/or breaks during filling of the vessel or winding it onto the spool, which events frequently occur due to the gauze-like consistency and poor mechanical strength of the fiber strip, the machine must be stopped so that the operator may replace the strip. This results in considerable downtime and, consequently, low output of the machine.

SUMMARY OF THE INVENTION

The aim of the present invention is to provide a machine of the aforementioned type for feeding a textile machine. The machine of the invention is designed to provide high output even in the event of a break in the supply fiber strips. The machine automatically repairs the broken strips by splicing the textile fibers. A further aim of the present invention is to provide a process for rapidly and economically splicing the strip fibers, which process is designed to be incorporated with a feeding machine of the aforementioned type. With this aim in view, according to the present invention, there is provided a process for splicing strip fibers, in particular, for splicing the broken end of a supply fiber strip to the end of a standby strip having the same type of fibers as the supply strip. The process is characterized by the fact that it comprises the steps of:

gripping and overlapping the respective opposite first ends of two strips of fibers to be spliced together; and blowing a jet of compressed air onto the overlapping ends of the fibers being spliced together, until the ends of the fibers become matted.

The present invention also relates to a machine for feeding the drawing frame of a textile machine with a number of fiber strips. The machine is characterized by the fact that it comprises at least a first member for collecting a supply strip and at least a second member for collecting a standby strip. A channel is provided and inside which the supply strip runs and over which an initial portion of the standby strip is suspended. Means releasably support the portion of the standby strip. A sensor detects the continuity of the supply strip and is located upstream from the inlet of the channel. An air-powered device splices the overlapping fibers of the supply and standby strips. A vertically-moving gripping device supports the means supporting the standby strip and the air-powered splicing device. The gripping device is designed to be movable within the channel, so as to place the initial portion of the standby strip over the end of the supply strip portion located immediately downstream from the sensor, and to grip the strips between the bottom wall of the channel and the base of the gripping device itself.

BRIEF DESCRIPTION OF THE DRAWINGS

A non-limiting embodiment of the present invention will be described with reference to the accompanying drawings, in which.

DETAILED DESCRIPTION OF THE INVENTION

Figure 2:
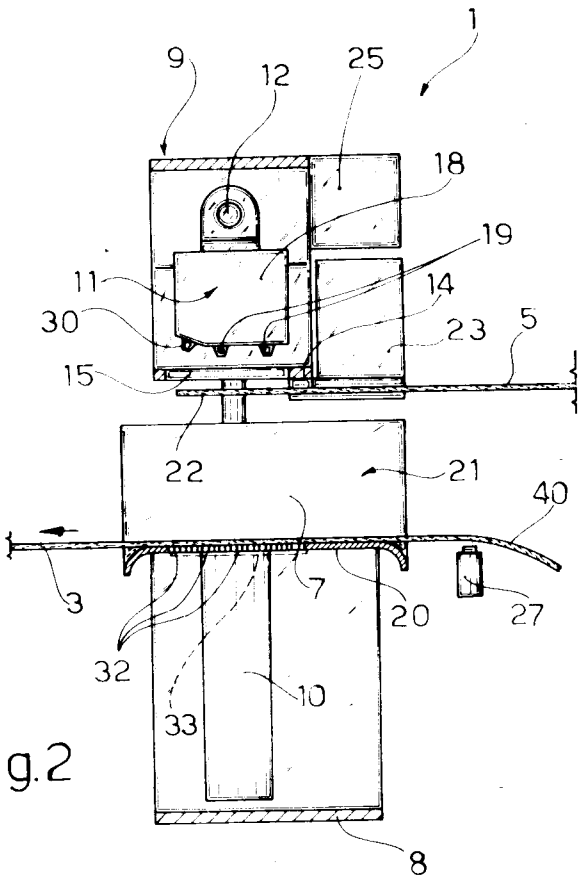
FIGS. 2, 3 and 4 illustrate schematic views of respective operating stages of the machine of FIG. 1.

Number 1 in FIGS. 1 to 4 indicates a machine for feeding any known type of textile machine (not shown), in particular, a pre-spinning or pre-combing, or any other type of textile machine fed with any type of textile fiber (natural, synthetic, or blended) in the form of strips.

The machine 1, as described and illustrated herein, relates, for the sake of simplicity, to a textile machine fed with a single fiber strip. This however, in no way detracts from the scope of the present invention, in that, obviously, the case of industrial machines, each supplied simultaneously with a number of strips, feeding machine according to the present invention will comprise a unit, identical to the one described and illustrated herein, for each strip being fed onto the textile machine.

Machine 1 comprises a first known type of collecting member 2, for example a vessel or a spool, about which is wound a strip 3 for feeding the drawing frame of the textile machine (not shown) and, according to the present invention, a second collecting member 4, of the same type as member 2 for each supply strip vessel or spool 2, and about which is wound a standby strip 5. The strips 3 and 5 are identical, of known type, and are formed from the same textile fibers. The free end (not shown) of strip 3 is connected to a drawing frame on the textile machine, and to respective components for feeding the textile machine. The components pull strip 3 in the direction of the arrow (FIGS. 1 and 2), so as to unwind it from member 2. Strip 5, on the other hand, remains stationary over strip 3 until it is used, as described later on, to replace strip 3 in the event of the latter either running out or breaking.

According to the present invention, machine 1 also comprises a channel 7, conveniently formed from bent sheet metal and supported on a known type of structure 8. A device 9 grips strips 3 and 5, and the device 9, is designed to move vertically over channel 7 and to be lowered inside the same by virtue of a vertical air-powered jack 10 supporting the entire device 9. Support structure 8 supports the channel 7 and the device 9. Air powered splicing device 11 is supported by device 9 in such a manner as to move crosswise in relation to the axis of channel 7. The device 9 also supports, in laterally projecting manner and on the jack 10 side, a further air-powered jack 12 perpendicular to jack 10 and rigidly connected to device 11 so as to move the latter on device 9 when activated. In the example shown, device 9 is defined by a straightforward metal bracket bent in the form of a loop and having a flat base 14, the entire width of which presents a rectangular, central through opening 15. Device 11 is suspended above opening 15, is housed loosely inside the metal bracket defining device 9, and is supported in projecting manner on the mobile rod of jack 12. Jack 12 extends laterally through the bracket so as to move device 11 across the entire width of opening 15.

According to the present invention, device 11 comprises a parallelepiped casing 18 having known couplings (not shown) for connecting the inside of device 11 to known Compressed air supply hoses (not shown). A pair of Vertical nozzles 19 are arranged side by side and face opening 15. The nozzles 19 direct jets of compressed air to the bottom wall 20 of channel 7. Actuators on jacks 10 and 12 are also connected in known manner (not shown) to compressed air hoses, and are controlled by a known, e.g. cam-activated, system via appropriate known valves, the arrangement of which will be obvious to any technician and is , therefore, not described for the sake of simplicity.

Inlet 21 of channel 7, faces the vessels or spools 4 and 2. Device 9 has a hinged forwardly projecting bracket 23 for supporting the front end 22 of strip 5. Bracket 23 is an L-shaped swinging bracket hinged at point 24 in such a manner as to turn about an axis parallel with the longitudinal axis of channel 7 (FIG. 3) as shown by the arrows. Device 9 has an integral electromagnet 25, disposed above bracket 23 preferably controlled by the system (not shown) which controls actuators 10 and 12. Electromagnet 25, when energised, attracts the top wing of bracket 23 in such a manner as to maintain the same in the position shown by the continuous line in the accompanying drawings. The force of gravity tends to turn bracket 23 into the down-turned position shown by the dotted line in FIG. 3.

In the position in which it is maintained by electromagnet 25, bracket 23 supports the end 22 of strip 5 above the portion of strip 3 positioned within channel 7, and outside the channel 7. In the down-turned position, on the other hand, bracket 23 cannot support strip 5 which, therefore, drops down on to strip 3 inside channel 7.

Figure 1:
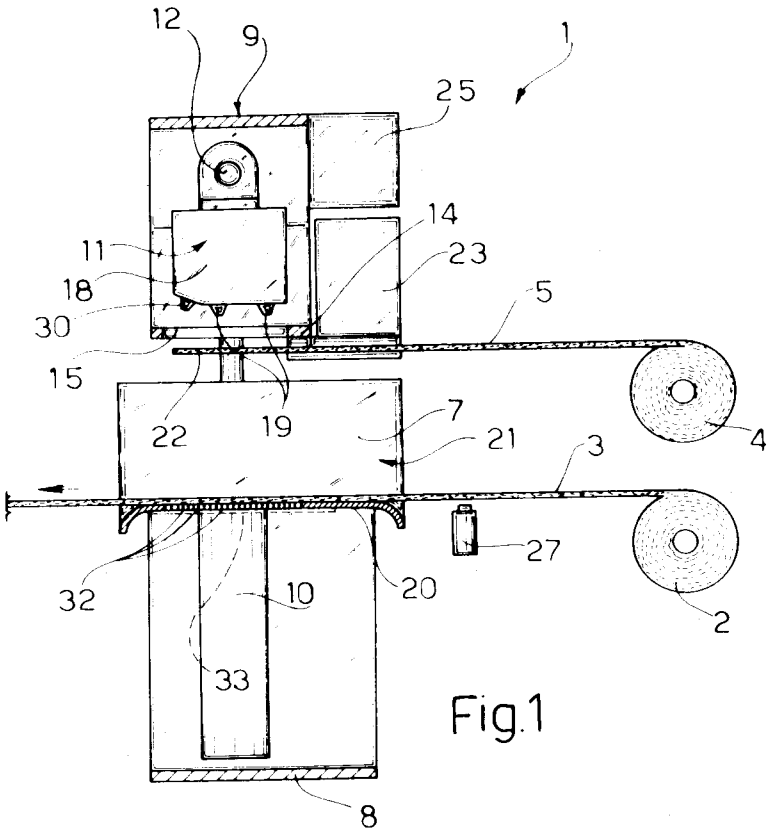
FIG. 1 illustrates a machine for feeding a drawing frame of a textile machine (not shown) in accordance with the teachings of the present invention.
Figure 3:
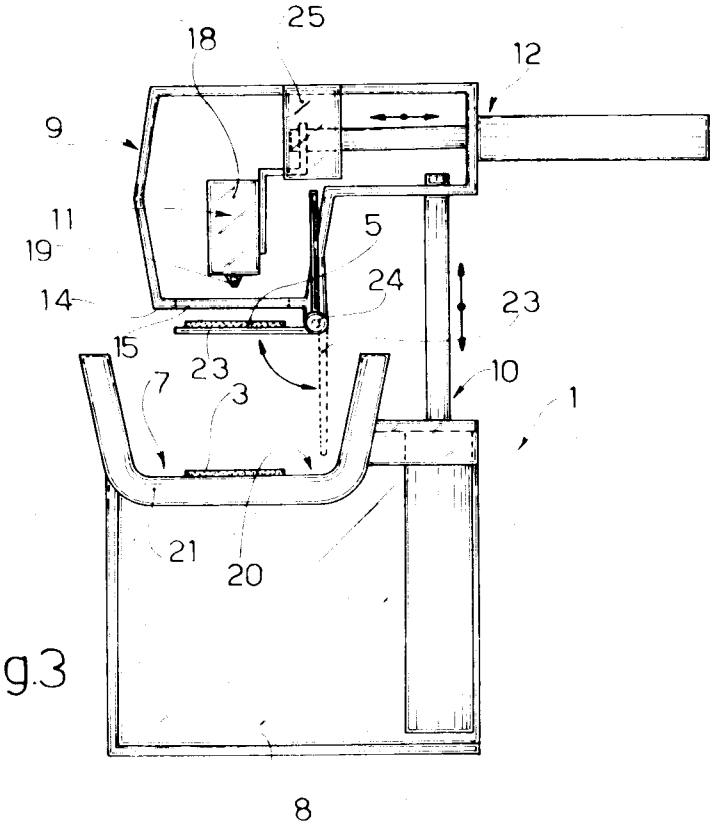

Immediately upstream from inlet 21, in relation to the traveling direction of strip 3 shown by the arrow in FIGS. 1 and 2, is an optical continuity sensor 27, e.g. a photocell, which detects any break or termination of strip 3. Device 11 also includes an obliquely disposed nozzle 30 located on the opposite side to vessels or spools 2 and 4 and adjacent nozzles 19. Nozzle 30 supplies a jet of compressed air substantially tangential to the end edge of end 22 of strip 5. Bottom wall 20 of channel 7 has a number of through holes 32 for exhausting the compressed air supplied by nozzles 19 and 30. Filtering element 33, defined by a wire net located underneath holes 32 is suspended underneath wall 20.

Figure 4:
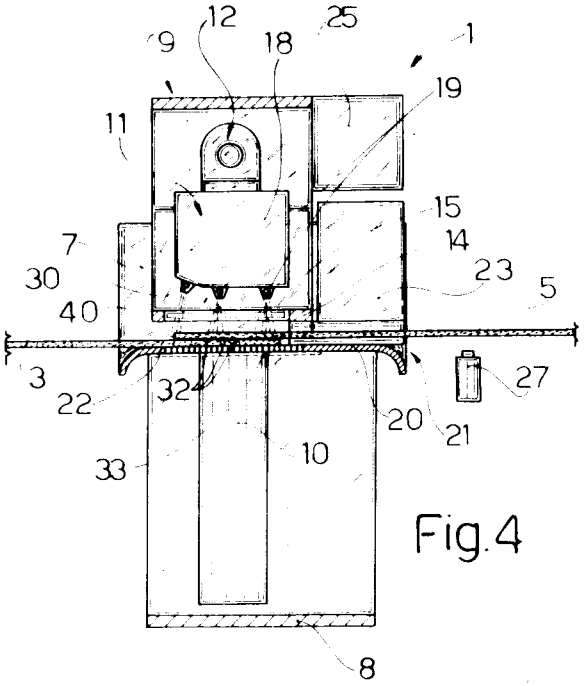

In actual use, strip 3 normally runs off member 2 and along wall 20, while strip 5 is held stationary with end 22 gripped between bracket 23 and base 14 of gripping device 9. When strip 3 runs out or breaks (FIG. 2), the terminal end 40 of strip 3 is pulled through channel 7 so as to uncover sensor 27. When this happens, sensor 27, which is connected to the control system (not shown), stops the textile machine (not shown) being fed by machine 1, arrests end 40 inside channel 7, and activates actuator 10 so as to bring device 9 down inside channel 7. Device 9 grips and overlaps ends 22 and 40 between base 14 and bottom wall 20, with the fibers of strips 3 and 5 arranged substantially parallel (FIG. 4). At this point, nozzles 19 and 30 and actuator 12 are activated simultaneously, so as to cause the nozzles to travel crosswise in relation to the fibers of strips 3 and 5. Nozzles 19 and 30 blow two vertical jets of compressed air onto the strips 3 and 5 through opening 15. The air is preferably, at a pressure of around 8 Atm, which experiments by the Applicants showed to be the most effective, although the pressure may range between 5 and 10 Atm. The jets are applied for a few tenths of a second, or long enough to cause matting of the fibers. This, together with the pressure exerted by the compressed air, causes the overlapping ends of the fibers of ends 22 and 40 to be spliced together. In this way, standby strip 5 is spliced to the broken portion or end of strip 3 already fed downstream from machine 1.

Nozzle 30 blows an oblique jet onto the fibers of strip 5, which jet, being tangent to end 22, holds down the fibers of end 22 against those of end 40 of strip 3. This causes both sets of fibers to intermingle, and thus overcomes the natural tendency of the fibers on end 22 to curl up as a result of the mechanical gripping force exerted on end 22 by base 14 (FIG. 4). Once strips 3 and 5 have been spliced, the textile machine is re-started and, at the same time, device 9 is lifted out of channel 7 and electromagnet 25 is de-energized so as to release bracket 23, which, by force of gravity, swings down into the position shown by the dotted line (FIG. 3) so as to free strip 5. Pulled by the portion of strip 3 to which it has been spliced, strip 5 drops down inside channel 7 within which it is fed, in place of broken or terminated strip 3, to the drawing frame on the textile machine (not shown) catered for by machine 1. Sensor 27 is also de-activated by virtue of strip 5 dropping down onto bottom wall 20 as so covering sensor 27. When operated as described, machine 1, which may achieve the same performance, even with an entirely different structure, provides for fast, cheap, efficient, fully automatic splicing of the end portion of a broken or terminated strip to a standby strip, thus drastically reducing downtime of the textile machine. Once the broken or terminated strip is detected, all the operator has to do is to set a new standby strip in place of broken or terminated strip 3. This is done by placing the end of the strip on bracket 23 and resetting, e.g. manually, electromagnet 25 to ensure further automatic operation in the event of further breakage or termination of the strip.

We claim:

1. A machine (1) for feeding the drawing frame on a textile machine with a number of fiber strips (3); characterized by the fact that it comprises at least a first member (2) for collecting a supply strip (3); at least a second member (4) for collecting a standby strip (5); a channel (7) inside which said supply strip (3) runs and over which is suspended the initial portion (22) of said standby strip (5); releasable means (23) for supporting said portion of said standby strip (5); a sensor (27) for detecting the continuity of said supply strip (3) and located upstream from the inlet on said channel (7); an air-powered device (18) for splicing the overlapping fibers of said supply and said standby strips (3, 5); and a vertically-moving gripping device (9) supporting said means (23) supporting said standby strip, and said air-powered splicing device (18); said gripping device (9) being designed to move down inside said channel (7), so as to place said initial portion (22) of said standby strip (5) over the end (40) of said supply strip (3) portion located immediately downstream from said sensor (27), and to grip said strips between the bottom wall (20) of said channel (7) and the base (14) of said gripping device (9) itself.

2. A machine as claimed in claim 1, characterized by the fact that said air-powered splicing device (18) comprises a pair of vertical, side-by-side nozzles (19) supported in crosswise-sliding manner on said gripping device (9) and designed to blow compressed air into said channel (7) through an opening (15) formed through said base (14) on said gripping device (9); and an air-powered actuator (12) designed to control traversing of said nozzles (19); said bottom wall (20) of said channel (7) presenting a number of holes (32) for exhausting the compressed air, and a compressed air filtering element (33) located underneath said holes (32).

3. A machine as claimed in claim 2, characterized by the fact that said air-powered splicing device (18) comprises a third nozzle (30) arranged obliquely and facing the opposite way to said strip collecting members (2, 4).

4. A machine as claimed in claim 1, characterized by the fact that said releasable means for supporting said standby strip (5) comprises an L-shaped swinging member (23) designed to drop down through 90 degrees by force of gravity and hinged to said gripping device (9); and an electromagnet (25) designed to attract said swinging member (23) and so prevent it from dropping down by force of gravity.

5. A process for splicing the broken end of a supply fiber strip to the end of a standby fiber strip, comprising the steps of:

(a) overlapping an end portion of a first strip with an end portion of a second strip;

(b) directing compressed air onto the overlapped ends from a first side thereof by means of at least a first nozzle generating a jet of compressed air;

(c) exhausting the compressed air through a filtering element disposed on an opposite second side thereof after the air has passed through the overlapped ends;

(d) moving the jet of compressed air laterally across the overlapped ends until the ends have become matted.

6. A process as in claim 5, wherein:

(a) said step of directing the compressed air is accomplished through a plurality of nozzles, each nozzle generating a jet of compressed air.

7. A process as in claim 6, wherein:

said step of directing the compressed air is accomplished through a pair of nozzles for generating parallel jets of compressed air.

8. A process as in claim 7, including the step of:

(a) directing the compressed air through a third nozzle disposed obliquely to the plane of the strips and thereby generating an oblique jet of compressed air blowing toward the end of an overlying strip for forcing the overlying strip downwardly onto the underlying strip.

9. A process as in claim 6, including the step of:

(a) directing compressed air having a pressure range of from about 5 to about 10 Atmospheres.

10. A process as in claim 5, including the step of:

(a) overlapping the end portion of the first strip with the end portion of the second strip so that the fibers of the first strip are substantially parallel to the fibers of the second strip.

11. A process as in claim 5, including the step of:

(a) detecting the end of one of the strips thereafter initiating means for causing the end portions of the strips to be overlapped.

12. A process as in claim 11, including the step of:

(a) optically detecting the end of one of the strips.

13. A process for splicing the broken end of a supply fiber strip to the end of a standby fiber strip, comprising the steps of:

(a) overlapping an end portion of a first fibrous strip with an end portion of a second fibrous strip;

(b) directing onto the overlapped ends compressed air from one side thereof by means of at least a first nozzle generating a vertical jet of air and at least a second obliquely disposed nozzle generating an oblique jet of compressed air;

(c) exhausting the compressed air through a filtering element disposed on an opposite side of the overlapped ends after the air has passed through the overlapped ends; and (d) moving the jets of compressed air laterally across the overlapped ends until the fibers of the ends have become matted.

14. A process as in claim 13, wherein (a) the oblique jet of compressed air is directed toward the end of an overlying strip for forcing the overlying strip downwardly onto the underlying strip.

15. A machine for feeding the drawing frame on a textile machine with at least two fiber strips and with each strip wound about a spool, comprising:

(a) a channel for being disposed adjacent the strips and having an inlet for permitting one of the strips to pass therethrough;

(b) gripping means disposed adjacent said inlet for releasably supporting an end portion of the other strip so that the supported end portion may be selectively positioned in overlapping arrangement with an end portion of the other strip;

(c) sensor means positioned upstream of said inlet for detecting the continuity of the strip passing through said channel;

(d) air-powered means for splicing the overlapping end portions of the fiber strips; and (e) means operably interconnecting said air-powered means and said gripping means, said means operably interconnecting being disposed downstream of said sensor.

* * * * *